US009028380B2

(12) United States Patent
Hoole

(10) Patent No.: US 9,028,380 B2
(45) Date of Patent: May 12, 2015

(54) RESISTANCE BAND TENSIONER

(71) Applicant: Richard J. Hoole, New Smyrna Beach, FL (US)

(72) Inventor: Richard J. Hoole, New Smyrna Beach, FL (US)

( * ) Notice: Subject to any disclaimer, the term of this patent is extended or adjusted under 35 U.S.C. 154(b) by 211 days.

(21) Appl. No.: 13/840,168

(22) Filed: Mar. 15, 2013

(65) Prior Publication Data

US 2013/0210592 A1 Aug. 15, 2013

Related U.S. Application Data

(63) Continuation-in-part of application No. 11/811,920, filed on Jun. 11, 2007, now Pat. No. 7,871,360, and a continuation-in-part of application No. 12/156,487, filed on Jun. 2, 2008, now Pat. No. 7,918,770, and a continuation-in-part of application No. 12/658,855, filed on Feb. 16, 2010, now Pat. No. 8,147,389, and a continuation-in-part of application No. 12/944,808, filed on Nov. 12, 2010, now Pat. No. 8,734,305.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/12*** | (2006.01) |
| ***A63B 21/06*** | (2006.01) |
| *A63B 23/04* | (2006.01) |

(52) U.S. Cl.

CPC ..... *A63B 21/04* (2013.01); *A63B 21/0552* (2013.01); *A63B 23/1218* (2013.01); *A63B 21/0435* (2013.01); *A63B 2225/093* (2013.01); *A63B 21/0421* (2013.01); *A63B 21/0615* (2013.01); *A63B 21/1411* (2013.01); *A63B 21/1492* (2013.01); *A63B 23/1227* (2013.01); *A63B 2023/0411* (2013.01); *A63B 21/00065* (2013.01); *A63B 21/00072* (2013.01)

(58) Field of Classification Search

USPC ..... 482/121, 130, 482, 142, 100, 97

See application file for complete search history.

(56) References Cited

U.S. PATENT DOCUMENTS

| | | | | |
|---|---|---|---|---|
| 4,492,375 | A * | 1/1985 | Connelly | 482/138 |
| 5,407,404 | A * | 4/1995 | Killian et al. | 482/38 |
| 6,482,139 | B1 * | 11/2002 | Haag | 482/121 |

* cited by examiner

*Primary Examiner* — Jerome W Donnelly

(74) *Attorney, Agent, or Firm* — Matthew G. McKinney, Esq.; Allen, Dyer, Doppelt, Milbrath & Gilchrist, P.A.

(57) ABSTRACT

A resistance band tensioner is disclosed. The tensioner includes a main body and a pivot pin disposed on the main body proximate a first end, where the main body is configured to rotate about the pivot pin between an up position and a down position. The tensioner also includes a handle extending from a second end of the main body configured for a user to grasp with a hand. A cantilever shaft extends outward perpendicular from the main body and is interposed between the handle and the pivot pin, where the shaft is adapted to secure a first portion of a resistance band around its periphery. In addition, the tensioner includes a locking pin to lock the tensioner in the down position when the resistance band is placed under tension by rotating the main body from the up position to the down position.

20 Claims, 8 Drawing Sheets

RESISTANCE BAND TENSIONER

I CROSS REFERENCE TO RELATED APPLICATIONS

This application is a continuation-in-part of U.S. patent application Ser. No. 11/811,920 filed Jun. 11, 2007, now U.S. Pat. No. 7,871,360, and U.S. patent application Ser. No. 12/156,487 filed Jun. 2, 2008, now U.S. Pat. No. 7,918,770, and U.S. patent application Ser. No. 12/658,855 filed Feb. 16, 2010, now U.S. Pat. No. 8,147,389, and pending U.S. patent application Ser. No. 12/944,809 filed Nov. 10, 2010, and claims the benefit of the earlier filing date of these applications.

II FIELD

The present disclosure is generally related to a resistance band tensioner.

III. DESCRIPTION OF RELATED ART

The resistance band tensioner described herein may be used with weight lifting equipment for squat, dip, and chin exercises.

Squats exercise the muscles of the thighs, hips and buttocks, and also strengthen the bones, ligaments and tendons throughout the lower body. For this reason, squats are regarded as an important exercise for strength-increase in the legs and buttocks.

Ideally, a squat exercise series begins from a standing position. The knees and hips are bent to lower the torso, and then the body is then returned to the upright position. The squat can continue to a number of depths, but a correct squat should be at least to parallel and usually lower if flexibility allows. Squatting below parallel qualifies a squat as deep while squatting above it qualifies as shallow. A below-parallel squat relies on hip drive out of the bottom, thereby exercising the adductors, glutes, and hamstrings to provide power. The knee is not used to stabilize or intercept any part of the load as with a shallow-type squat. Correctly performed full squats can be safe on the knees while removing pressure from the lower lumbar region.

As the body descends, the hips and knees undergo flexion, the ankle dorsiflexes and muscles around the joint contract eccentrically, reaching maximal contraction at the bottom of the movement while slowing and reversing descent. The muscles around the hips provide the power out of the bottom. If the knees slide forward or cave in then tension is taken from the hamstrings, hindering power on the ascent. Returning to vertical contracts the muscles concentrically, and the hips and knees undergo extension while the ankle plantar flexes.

Dips are performed by pushing oneself above the level of a pair of parallel dip bars located approximately shoulder-width apart. The exerciser grasps a dip bar with each hand, then lowers his or her body until elbows are bent and shoulders mildly stretched. The arms are used to push the exerciser upwards to the starting position. Leaning the body forward with elbows kept in works the chest muscles more. Keeping the body straight vertically with elbows close to the body works the triceps more. More strenuous dips can be accomplished by not permitting the exerciser's feet to touch the floor at all during the course of the exercise.

Chins are performed by pulling oneself upwards above a pair of roughly co-linear chin bars, grasping one bar with each hand. The chin bars are located above the shoulder height of the exerciser. The exerciser begins by grasping a chin bar with each hand, with palms facing the exerciser. The exerciser then pulls himself or herself upwards until either chin or chest touches the chin bars. The exerciser then slowly lowers himself or herself back to the standing position from which the chin exercise was initiated. Chin exercises strengthen the biceps, forearms, and lateral muscles.

One of the hardest problems to solve associated with currently available squat, dip, and chin exercise apparatus is the inability to add significant resistance acting against the exerciser's upward motion during squats, dips and chins, thereby rendering the exercise more strenuous. Currently available squat-dip-chin machines are either not weightable, or provide means to use weights to aid the exerciser during the exercise, thus rendering the exercise less strenuous. Thus, in order to make the dips and chins more strenuous it would be desirable to provide means of adding weight against the exercise being performed, not in aid of the exercise. In addition, it would be desirable to provide means for using elastic to work against the exercise, thus increasing the exercise value.

One currently available option is for the exerciser to wear a weight belt, from which weights dangle. While these weights have the effect of increasing the weight of the exerciser, and hence the strenuousness of the exercise, the procedure can be dangerous if the weights swing into the exerciser's limb(s), or if the exerciser were to slip off of the elevated foot support(s) and the heavy weights land on the exerciser's feet or other body part. Thus, it would be desirable to provide a safe way to add force against the squat, dip or chin being performed, by safely adding weight acting against the squat, dip or chin being performed.

It would also be desirable to provide a safe way to add force against the squat, dip or chin being performed, by safely adding elastic members such as resistance bands acting against the squat, dip or chin being performed.

Accordingly, what is needed in the art is a resistance band tensioner that allows a user to easily add resistance bands for the exercises to increase the tension in the bands to levels that was previously unattainable to achieve.

IV. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a resistance band tensioner is disclosed. The tensioner includes a main body and a pivot pin disposed on the main body proximate a first end, where the main body is configured to rotate about the pivot pin between an up position and a down position. The tensioner also includes a handle extending from a second end of the main body, where the handle is configured for a user to grasp with a hand. The handle generally extends from the main body along a longitudinal centerline of the main body and may be angled to provide additional leverage to a user. A cantilever shaft extends outward from the main body, where the shaft is adapted to secure a first portion of a resistance band around its periphery. The shaft extends perpendicular to the main body and is interposed between the handle and the pivot pin. In addition, the tensioner includes a locking pin to lock the tensioner in the down position when the resistance band is placed under tension by rotating the main body from the up position to the down position.

The main body may also include a pair of side panels equidistantly spaced and secured together by a cross member, where the pair of side panels includes a pair of locking apertures that are aligned to receive the locking pin therethrough. The main body may be configured to fit within a U-shaped channel that is adapted to be secured to a frame of weight lifting equipment. Further, the U-shaped channel may include a plurality of receiving apertures disposed on each sidewall of the U-shaped channel, wherein the locking pin is configured to lock the tensioner in the down position when the receiving apertures of the U-shaped channel and the locking apertures of the side panels of the main body are aligned so that the locking pin can slide through. A second portion of the resistance band is adapted to be secured to a piece of the weight lifting equipment and to stretch and provide resistance as the piece of weight lifting equipment is moved by a user during exercise and the first portion of the resistance band is anchored by the tensioner that is locked in the down position.

The pair of side panels of the main body may include a pair of pivot apertures, where the pivot pin is configured to secure the first end of the tensioner to the U-shaped channel when the receiving apertures of the U-shaped channel and the pivot apertures of the side panels of the main body are aligned so that the pivot pin can slide through. The pivot pin may also include a perpendicular bore proximate a first end configured to receive a cotter pin to prevent the pivot pin from sliding back out of the receiving apertures.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

IV. BRIEF DESCRIPTION OF THE DRAWINGS

V. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Figure 1:
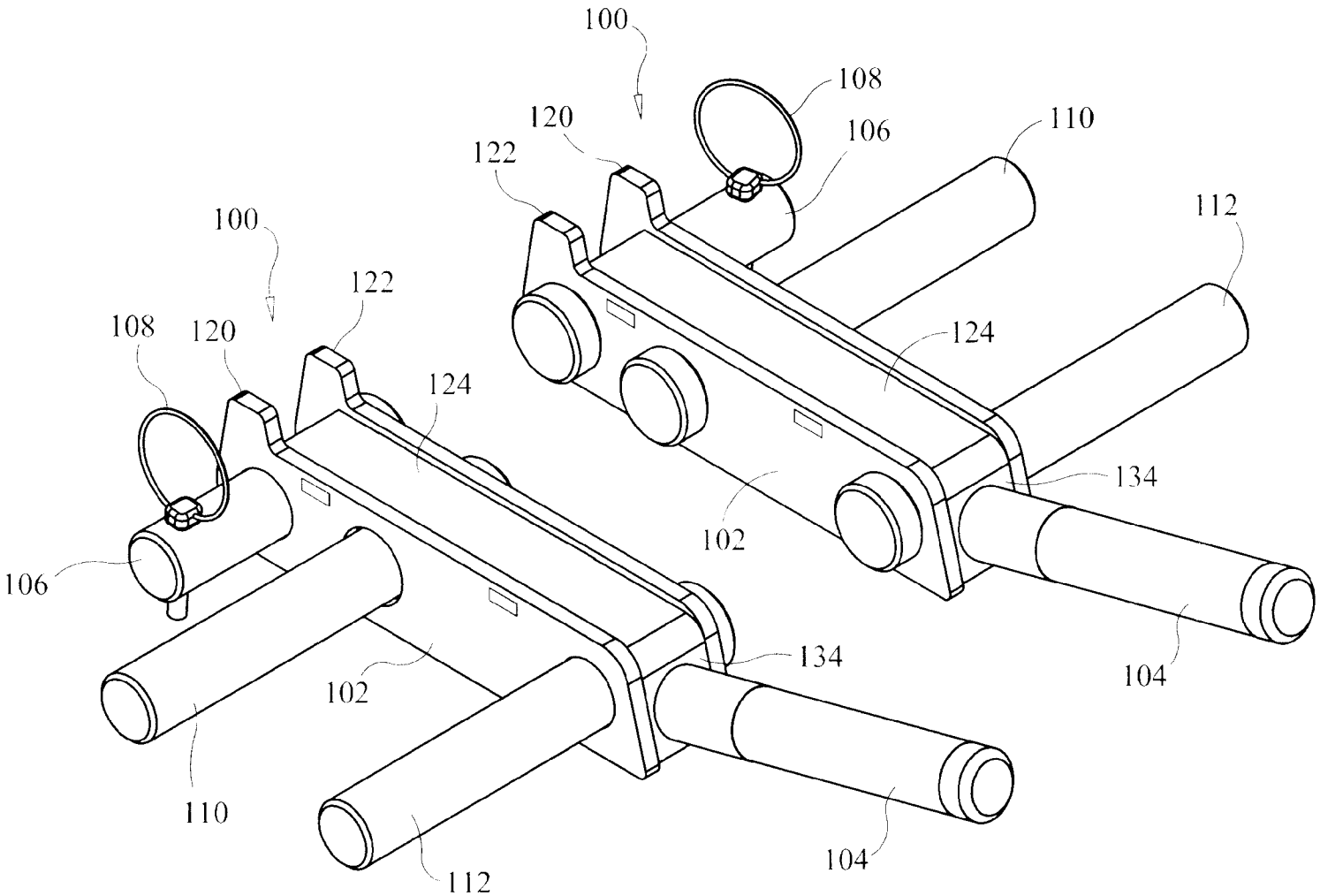
FIG. 1 is a perspective view of a particular illustrative embodiment of a pair of resistance band tensioners.

Referring now to FIG. 1, a pair of resistance band tensioners are disclosed and generally designated 100. A tensioner 100 may be used on each side of weight lifting equipment in a pair or only one tensioner 100 may be used. Each tensioner 100 includes a main body 102. The main body 102 is generally rectangular in shape with a handle 104 extending from an end of the main body 102. At a first end of the tensioner 100 opposite the handle 104, a pivot pin 106 is used to allow the tensioner 100 to rotate between an up position and a down and locked position. A cotter pin 108 may be inserted through boring 114 and used to secure the pivot pin 106 in place so that it cannot slide out. A removable locking pin 110 is disposed along the tensioner 100 between the pivot pin 106 and handle 104. In operation, the locking pin 110 is removed so that the tensioner 100 can move to the up position. The locking pin 110 then is inserted once the tensioner 100 is in the down position so that the locking pin 110 prevents the tensioner from rotating up and maintains the tension in the resistance band as explained below. The locking pin 110 is installed generally perpendicular to a longitudinal centerline of the tensioner 100. The main body 102 of the tensioner 100 may include a pair of side panels 120, 122.

Figure 2:
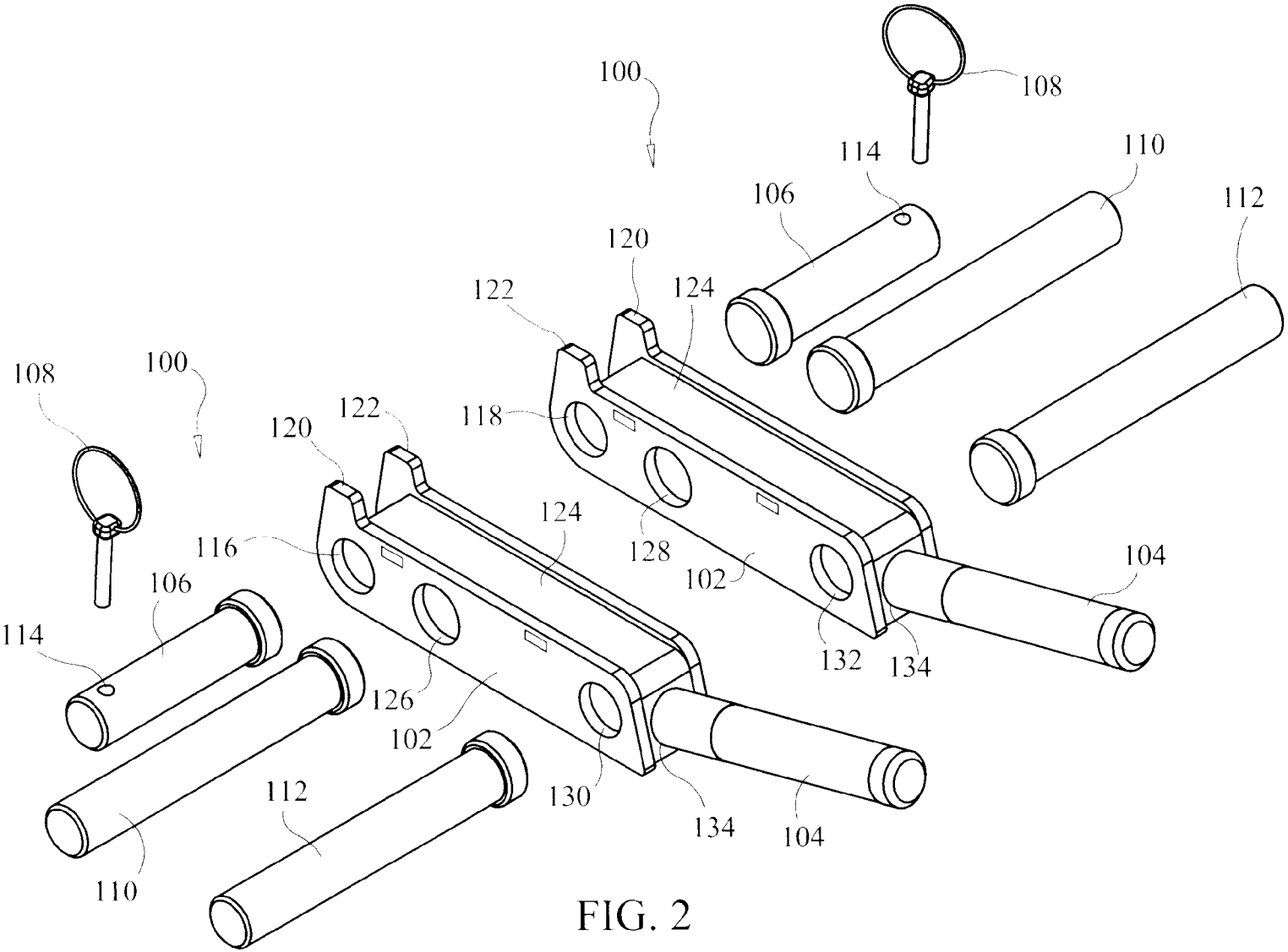
FIG. 2 is a partial exploded perspective view of the embodiment shown in FIG. 1.

The side panels 120, 122 may be joined together by cross member 124 to form an open box beam. Alternatively, the main body 102 may be solid material. As can be seen in FIG. 2, a plurality of apertures are disposed along the side panels 120, 122. The pivot pin 106 is sized to slide through aperture 116 on side panel 120 and out aperture 118 on opposing side panel 122. Locking pin 110 is similarly sized so that it may be easily slid into and out of aperture 126 and 128. Shaft 112 may also be configured and sized to slide through respective apertures 130 and 132. Alternatively, shaft 112 may be permanently mounted to the main body. Shaft 112 is used to secure a first portion of a resistance band around its periphery.

Figure 3:
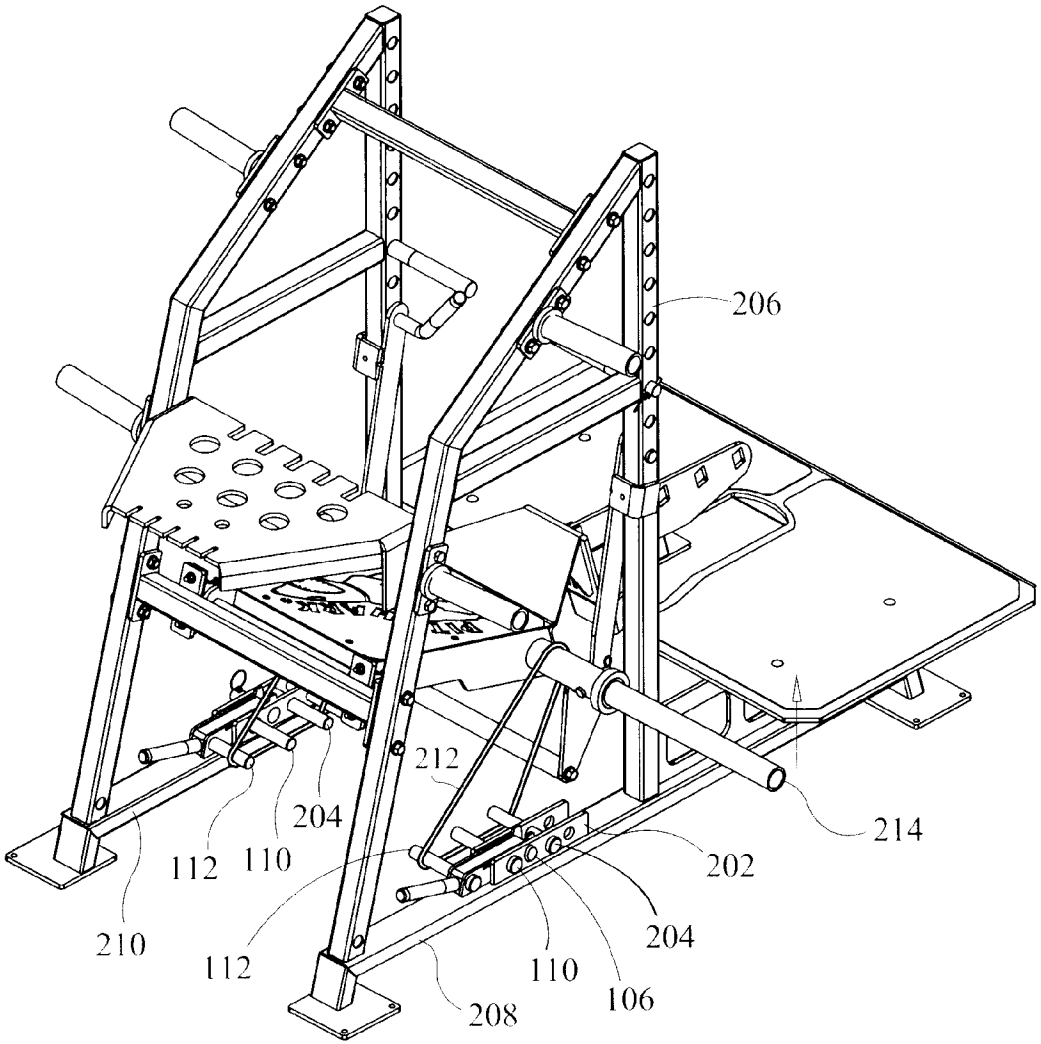
FIG. 3 is a right perspective view of weight lifting equipment with the resistance band tensioners installed on the weightlifting equipment with the resistance bands in tension.
Figure 4:
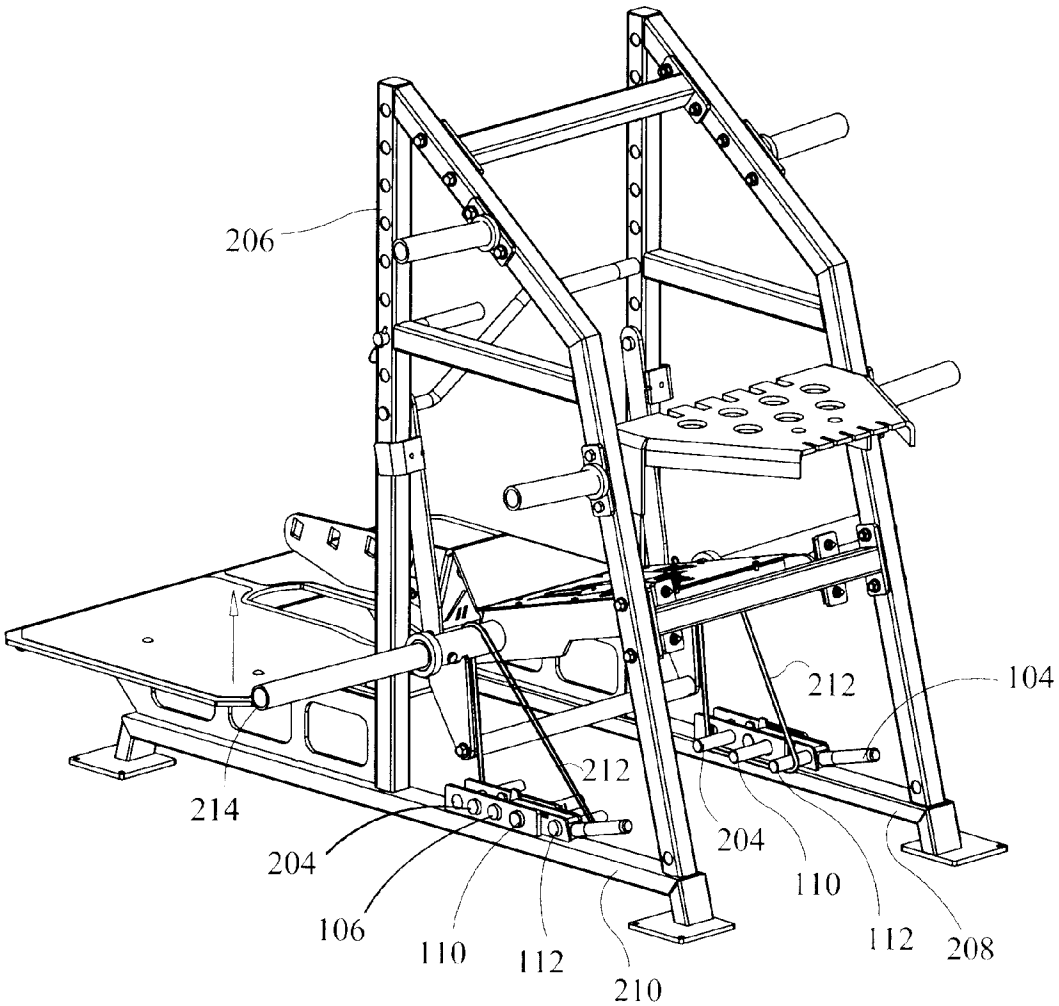
FIG. 4 is left perspective view of the weight lifting equipment shown in FIG. 3.
Figure 5:
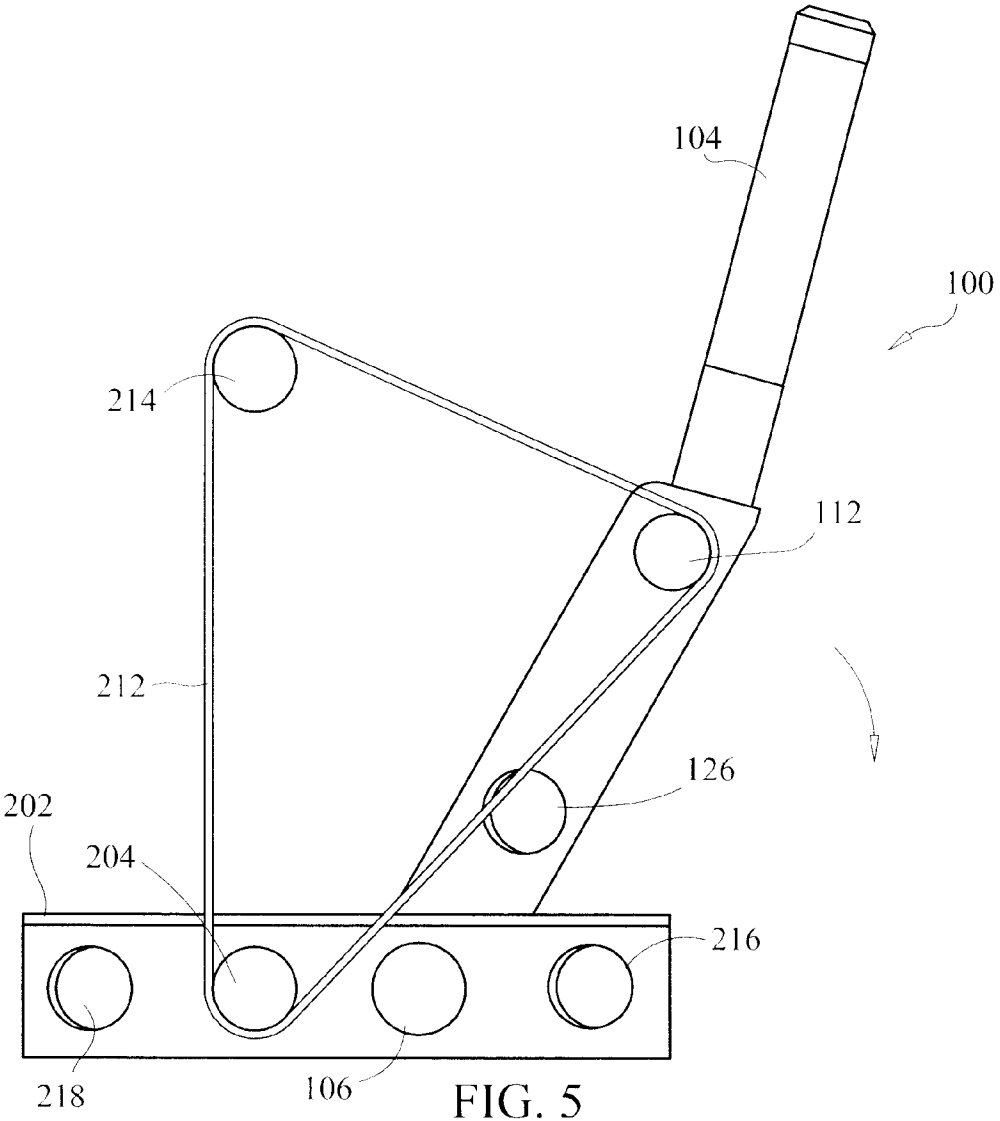
FIG. 5 is an elevational view of the resistance band tensioner in an up position.

As best shown in FIGS. 3 and 4, the tensioners 100 are installed on the weight lifting equipment 206 on rails 208, 210. The tensioners 100 are in a down position and locked with the resistance bands 212 in tension. A first portion of the resistance band is secured around shaft 112 and the second portion secured around a piece of the weight lifting equipment 214. Although the resistance band 212 is shown as a loop, the resistance band can also be a single length secured between the shaft 212 and weight lifting equipment 214. In operation, the user would stand on a platform of the equipment 206, and move against the tension of the resistance band 212 by moving the piece of equipment 214 upwards. Various attachments may be used so that the user can perform squat, dip or chin exercises. Any number of resistance bands 212 may be used, where more bands 212 increases the resistance and more strength is required to install the bands 212 and place under tension. Thus, using the band tensioner 100 to add and remove the resistance bands 212 is easy by using a mechanical advantage of the tensioner 100 as a lever.

Referring now to FIG. 4, an elevational view of the tensioner 100 is shown. An anchor plate 202 (or one side of a U-shaped channel) is used to anchor or lock the tensioner 100 in the down position when the resistance band 212 is in tension and being stretched during exercising. The anchor plate 202, or U-shaped channel, may be attached to an equipment rail 208, 210 and shown in FIGS. 3 and 4, or may simply be anchored to a stationary object such as a floor or wall. In this embodiment, the anchor plate 202 is shown with four apertures, however, any number of apertures may be used so that the distance that the band 212 is stretched may be adjusted and accommodate different sizes of bands 212. An open aperture 218 is shown proximate a first end of the anchor plate 202 and is not used in this particular example. An optional pin 204 is shown inserted so that the angle of the resistance band 212 relative to the handle 104 is modified. The first portion of the resistance band 212 is stretched over the shaft 112, where the tensioner 100 is in the up position so that the band 212 is somewhat slack and easy to install. The second portion of the band 212 is around the piece of weight-lifting equipment 214. The pivot pin 106 is inserted and secured through the anchor plate 202 so that the tensioner 100 is free to rotate between the up position and the down and locked position. Locking aperture 126 is configured to align with an aperture 216 of the anchor plate 202 when the tensioner 100 is moved downward to the locked position, so that the locking pin 110 may be inserted therethrough.

Figure 6:
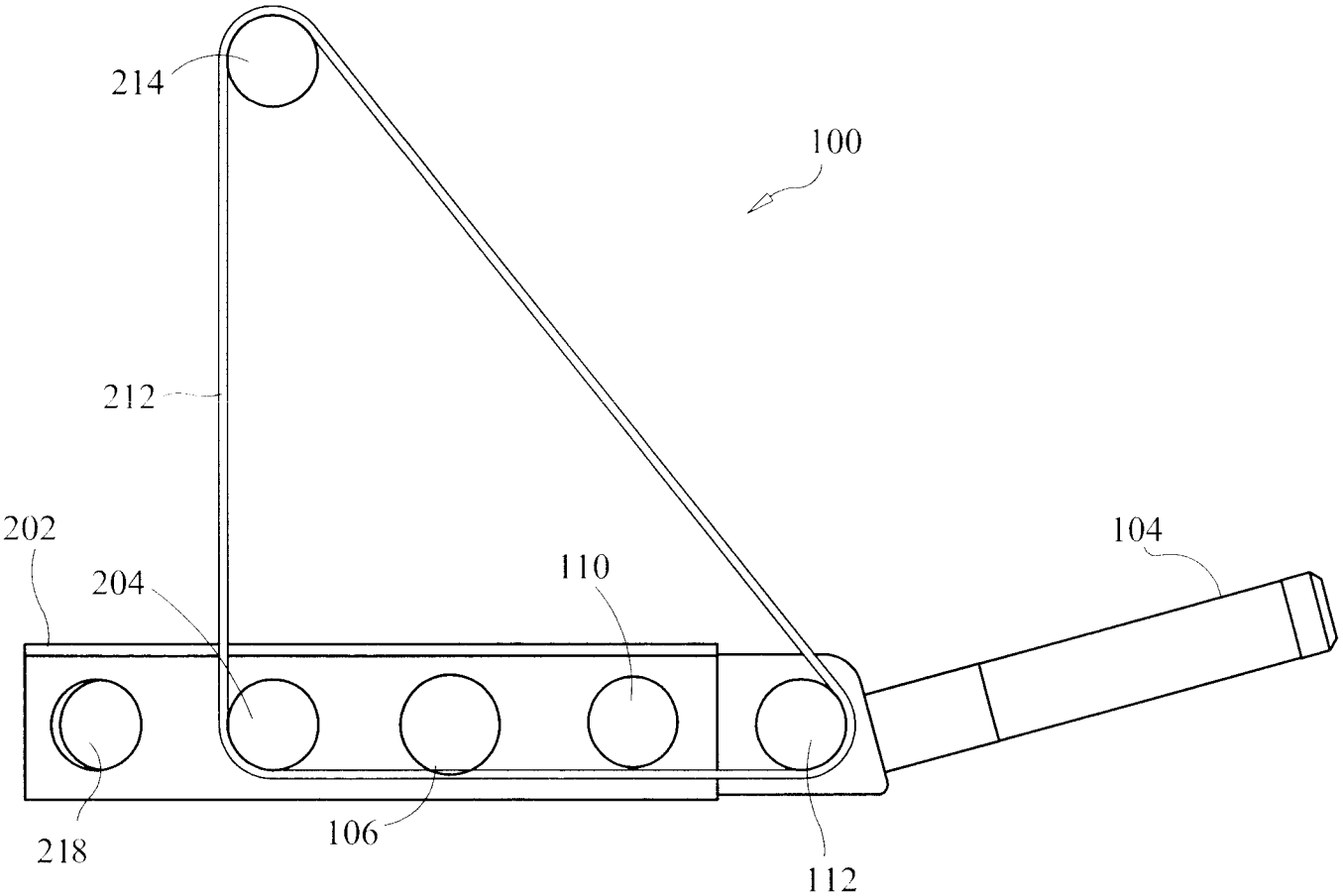
FIG. 6 is an elevational view of the resistance band tensioner shown in FIG. 5 moved to a down and locked position with a resistance band in tension.

Moving to FIG. 6, the tensioner 100 is shown in the down and locked position. The locking pin 110 has been inserted through aperture 216 and locking aperture 126 of the tensioner 100. Thus, the tensioner 100 will remain in the locked position allowing the resistance band 212 to be used under significant tension. The tension band 212 has been stretched to increase the resistance to the user during exercising. The pivot pin 106 acts a fulcrum so that the force needed to overcome the load imparted by the resistance band 212 is reduced. It is relatively impossible, if not impossible, to stretch the resistance band 212 by hand to the tension levels that the tensioner 100 can achieve due to its mechanical advantage.

Figure 7:
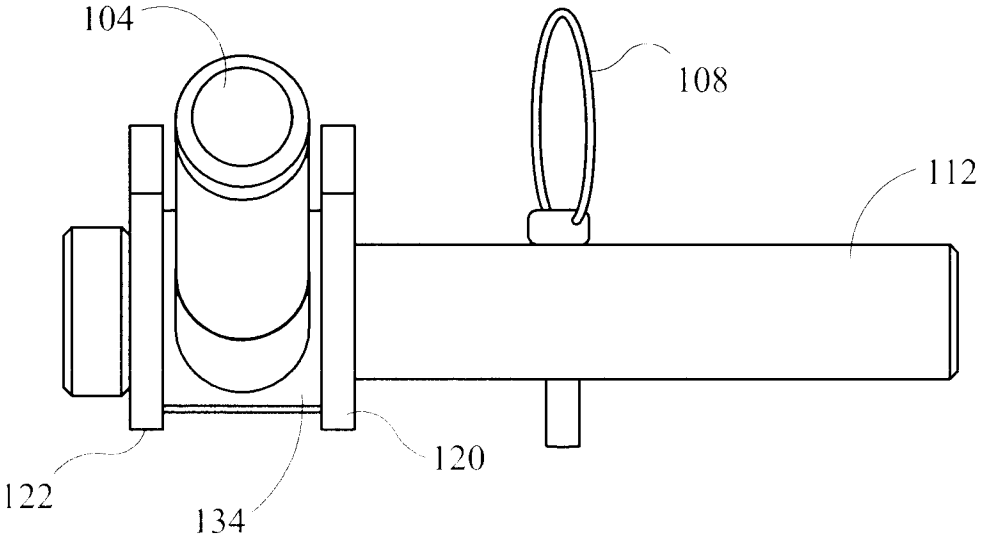
FIG. 7 is a front elevational view of the resistance band tensioner.
Figure 8:
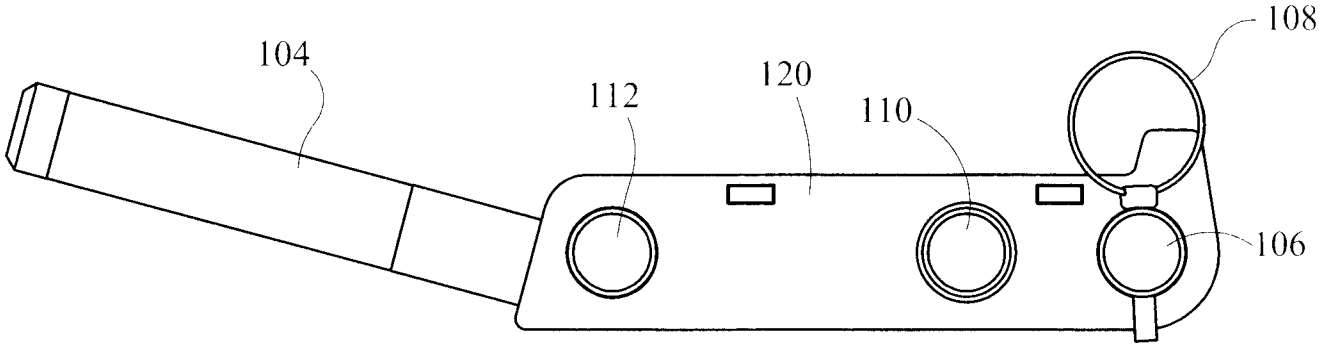
FIG. 8 is a side elevational view of the resistance band tensioner.
Figure 9:
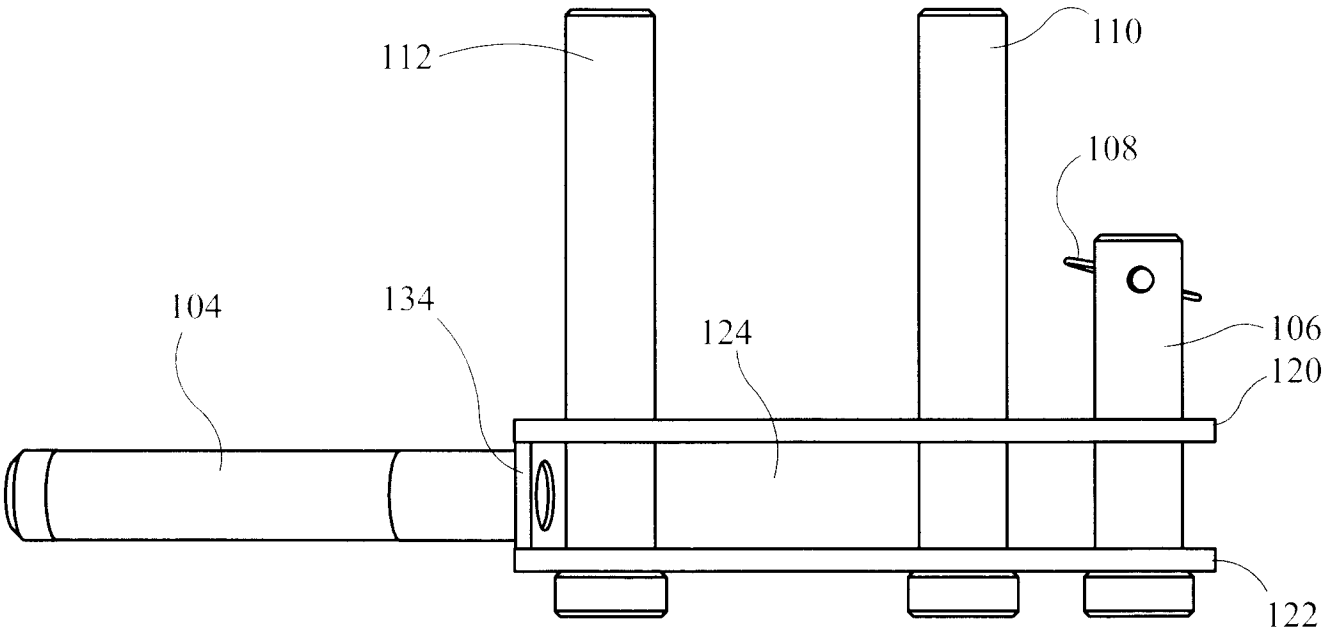
FIG. 9 is a bottom view of the resistance band tensioner.

FIG. 7 is a front elevational view of the tensioner 100 showing that the handle 104 may be angled upwards relative to the main body 102 to make it easier for the user to grasp and push downward without crushing any fingers. The shaft 112 extends outward perpendicular and cantilevered out from the main body 102 to provide significant area from any number of resistance bands 212 to wrap around. The shaft 112, locking pin 110 and pivot pin 106 may each have a head portion that is configured to prevent the respective pin from being pushed all the way into the main body 102 inadvertently. FIG. 8 shows a side elevational view with the shaft 112, locking pin 110 and pivot pin installed within the respective aperture of the main body 102. FIG. 9 is a bottom view of the tensioner 100. As can be seen, the tensioner includes a pair of side panels 120, 122 that are joined together by cross member 124. The side panels 120, 122 are generally parallel to one another. A front panel 134 of the tensioner 100 may be used to secure the handle 104 to the main body 102.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A resistance band tensioner, the tensioner comprising:

a main body;

a pivot pin disposed on the main body proximate a first end, wherein the main body is configured to rotate about the pivot pin between an up position and a down position;

a handle extending from a second end of the main body, wherein the handle is configured for a user to grasp with a hand;

a cantilever shaft extending outward from the main body, wherein the shaft is adapted to secure a first portion of a resistance band around its periphery; and a locking pin to lock the tensioner in the down position when the resistance band is placed under tension by rotating the main body from the up position to the down position.

2. The resistance band tensioner of claim 1, the main body further comprising a pair of side panels equidistantly spaced and secured together by a cross member.

3. The resistance band tensioner of claim 2, the pair of side panels further comprising a pair of locking apertures, wherein the locking apertures are aligned to receive the locking pin therethrough.

4. The resistance band tensioner of claim 3, wherein the main body is configured to fit within a U-shaped channel that is adapted to be secured to a frame of weight lifting equipment.

5. The resistance band tensioner of claim 4, the U-shaped channel further comprising a plurality of receiving apertures disposed on each sidewall of the U-shaped channel, wherein the locking pin is configured to lock the tensioner in the down position when the receiving apertures of the U-shaped channel and the locking apertures of the side panels of the main body are aligned so that the locking pin can slide through.

6. The resistance band tensioner of claim 5, wherein a second portion of the resistance band is adapted to be secured to a piece of the weight lifting equipment and to stretch and provide resistance as the piece of weight lifting equipment is moved by a user during exercise and the first portion of the resistance band is anchored by the tensioner that is locked in the down position.

7. The resistance band tensioner of claim 6, the pair of side panels of the main body further comprising a pair of pivot apertures, wherein the pivot pin is configured to secure the first end of the tensioner to the U-shaped channel when the receiving apertures of the U-shaped channel and the pivot apertures of the side panels of the main body are aligned so that the pivot pin can slide through.

8. The resistance band tensioner of claim 7, wherein the shaft extends perpendicular to the main body.

9. The resistance band tensioner of claim 8, wherein the shaft is interposed between the handle and the pivot pin.

10. The resistance band tensioner of claim 9, wherein the handle extends from the main body along a longitudinal centerline of the main body.

11. The resistance band tensioner of claim 10, the pivot pin further comprising a perpendicular bore proximate a first end configured to receive a cotter pin to prevent the pivot pin from sliding back out of the receiving apertures.

12. A resistance band tensioner, the tensioner comprising:

a pivot pin proximate a first end of the tensioner and configured to rotatably secure the tensioner so that the tensioner is configured to rotate about the pivot pin between an up position and a down position;

a handle extending from a second end of the tensioner, wherein the handle is configured to assist in moving the tensioner between the up and down positions;

a perpendicular shaft extending outward from the tensioner between the pivot pin and the handle, wherein the shaft is adapted to secure a first portion of a resistance band around its periphery and a second portion of the resistance band is adapted to be secured around a piece of weight lifting equipment; and a locking pin to lock the tensioner in the down position when the resistance band is placed under tension by rotating the tensioner from the up position to the down position.

13. The tensioner of claim 12, the tensioner further comprising a cross member.

14. The tensioner of claim 13, further comprising an anchor plate separately secured to a stationary object.

15. The tensioner of claim 14, wherein the stationary object is the frame of the weight lifting equipment.

16. The tensioner of claim 14, the anchor plate further comprising a plurality of receiving apertures configured to align and receive the locking pin to lock the tensioner to the stationary object.

17. The tensioner of claim 16, wherein the pivot pin, locking pin, and shaft are removable from the tensioner.

18. The tensioner of claim 17, wherein the pivot pin and locking pin are configured to slide through the tensioner perpendicular to a longitudinal centerline of the tensioner.

19. The tensioner of claim 18, wherein a diameter of the receiving apertures are configured to guide the locking pin therethrough.

20. A resistance band tensioner, the tensioner comprising:

a pivot pin disposed on a first end of the tensioner and configured to rotatably secure the tensioner to an object;

a handle extending from an opposing second end of the tensioner along a longitudinal centerline;

a shaft extending outward from the tensioner between the pivot pin and the handle and configured to secure a first portion of a resistance band around its periphery and a second portion of the resistance band is adapted to be secured around a piece of weight lifting equipment; and a removable locking pin to lock the tensioner in the down position when the resistance band is placed under tension by rotating the tensioner from the up position to the down position.

* * * * *